US008734272B2

(12) United States Patent
Tutmark

(10) Patent No.: US 8,734,272 B2
(45) Date of Patent: May 27, 2014

(54) GOLF BALL WEAR INDICATOR

(75) Inventor: Bradley C. Tutmark, Aloha, OR (US)

(73) Assignee: Nike, Inc., Beaverton, OR (US)

( * ) Notice: Subject to any disclaimer, the term of this patent is extended or adjusted under 35 U.S.C. 154(b) by 1003 days.

(21) Appl. No.: 12/691,282

(22) Filed: Jan. 21, 2010

(65) Prior Publication Data

US 2011/0177883 A1 Jul. 21, 2011

(51) Int. Cl.
*A63B 37/08* (2006.01)

(52) U.S. Cl.
USPC ..... 473/370

(58) Field of Classification Search
USPC ..... 473/324–378
See application file for complete search history.

(56) References Cited

U.S. PATENT DOCUMENTS

| | | | | | |
|---|---|---|---|---|---|
| 4,235,441 | A | * | 11/1980 | Ciccarello | 473/267 |
| 4,798,386 | A | * | 1/1989 | Berard | 473/374 |
| 4,998,734 | A | * | 3/1991 | Meyer | 473/356 |
| 5,208,132 | A | * | 5/1993 | Kamada et al. | 430/138 |
| 5,322,031 | A | | 6/1994 | Lerner et al. | |
| 5,427,378 | A | * | 6/1995 | Murphy | 473/353 |
| 5,566,937 | A | | 10/1996 | Lorhpipat et al. | |
| 5,584,767 | A | | 12/1996 | Picchietti et al. | |
| 5,713,799 | A | * | 2/1998 | Balmat | 473/200 |
| 5,823,891 | A | * | 10/1998 | Winskowicz | 473/378 |
| 5,849,463 | A | * | 12/1998 | Tsuji et al. | 430/302 |
| 5,938,544 | A | * | 8/1999 | Winskowicz | 473/378 |
| 5,989,135 | A | | 11/1999 | Welch | |
| 5,997,405 | A | | 12/1999 | Russell et al. | |
| 6,120,394 | A | * | 9/2000 | Kametani | 473/378 |
| 6,277,037 | B1 | * | 8/2001 | Winskowicz et al. | 473/378 |
| 6,358,160 | B1 | * | 3/2002 | Winskowicz | 473/378 |
| 6,513,370 | B1 | | 2/2003 | Williams | |
| 6,558,277 | B1 | * | 5/2003 | Ohira et al. | 473/378 |
| 6,623,382 | B2 | * | 9/2003 | Winskowicz | 473/378 |
| 6,780,127 | B2 | * | 8/2004 | Kennedy, III | 473/378 |
| 6,878,076 | B2 | * | 4/2005 | Winskowicz | 473/378 |
| 6,986,719 | B2 | * | 1/2006 | Kennedy, III | 473/378 |
| 7,056,230 | B2 | * | 6/2006 | Emalfarb | 473/351 |
| 7,070,518 | B2 | * | 7/2006 | Kennedy, III | 473/378 |

(Continued)

FOREIGN PATENT DOCUMENTS

| | | |
|---|---|---|
| CN | ZL201120022056 | 7/2012 |
| EP | 2347801 | 1/2013 |

(Continued)

OTHER PUBLICATIONS

Communication under Rule 71(3) EPC (Notice of Intention to Grant) in European Patent Application No. EP 11 151 422.0-2318, mailed on Jul. 17, 2012.

(Continued)

*Primary Examiner* — Alvin Hunter
(74) *Attorney, Agent, or Firm* — Quinn Law Group, PLLC

(57) ABSTRACT

A golf ball includes a cover that includes a plurality of layers over the core. A reacting layer changes when exposed to a particular atmospheric or environmental agent. A protecting layer protects the reacting layer from exposure to the agent. A top layer covers the other layers, though the top layer, the protecting layer, and the reacting layer may be intermingled with each other to varying degrees. Upon deterioration of the top layer and the protecting layer, the reacting layer becomes exposed to the agent and undergoes a change. This change alerts a golfer to the deterioration of the ball.

15 Claims, 6 Drawing Sheets

(56) References Cited

U.S. PATENT DOCUMENTS

| | | | | |
|---|---|---|---|---|
| 7,169,859 | B2 * | 1/2007 | Davis et al. | 525/437 |
| 7,179,856 | B2 * | 2/2007 | Park et al. | 524/430 |
| 7,214,145 | B2 * | 5/2007 | Park et al. | 473/378 |
| 7,226,961 | B2 * | 6/2007 | Park et al. | 523/205 |
| 7,244,193 | B2 * | 7/2007 | Emalfarb | 473/351 |
| 7,367,902 | B2 * | 5/2008 | Nagasawa | 473/378 |
| 7,648,429 | B2 * | 1/2010 | Nagasawa | 473/378 |
| 7,722,483 | B2 * | 5/2010 | Morgan et al. | 473/378 |
| 7,772,315 | B2 * | 8/2010 | Lee et al. | 524/492 |
| 7,967,702 | B2 * | 6/2011 | Winskowicz et al. | 473/378 |
| 8,029,386 | B2 * | 10/2011 | Watanabe | 473/378 |
| 8,272,977 | B2 * | 9/2012 | Oldknow | 473/376 |
| 2003/0109329 | A1 * | 6/2003 | Kennedy, III | 473/351 |
| 2004/0034122 | A1 | 2/2004 | Lacy | |
| 2007/0119363 | A1 | 5/2007 | Neto et al. | |

FOREIGN PATENT DOCUMENTS

| | | | | | |
|---|---|---|---|---|---|
| JP | 04122372 | A * | 4/1992 | | A63B 37/00 |
| JP | 2002-504383 | | 2/2002 | | |
| JP | 2003052881 | A * | 2/2003 | | A63B 69/36 |
| JP | 2005052510 | A * | 3/2005 | | A63B 37/00 |
| JP | 2005224427 | | 8/2005 | | |
| WO | WO99/17844 | | 4/1999 | | |
| WO | 0181457 | | 11/2001 | | |
| WO | 2004053004 | | 6/2004 | | |

OTHER PUBLICATIONS

Extended European Search Report dated May 6, 2011 in European Application No. 11151422.0-2318.

First Office Action in Chinese Invention Patent Application No. 201110025954.4, issued on Feb. 25, 2013.

Response to First Office Action issued Feb. 25, 2013 in Chinese Invention Patent Application No. 201110025954.4, as filed on Jun. 17, 2013 and the English translation thereof.

Office Action in Japanese Patent Application No. 2011-008429, issued Jul. 16, 2013.

Official Letter and Search Report mailed Apr. 29, 2013 for Taiwan Patent Application No. 10010079.

Communication pursuant to Rules 70(2) adn 70a(2) EPC and reference to Rule 39(1) EPC in European Patent Application No. EP11151422.0, mailed on Aug. 1, 2011.

Response to Official Communication in European Patent Application No. EP 11151422.0, submitted on Jan. 19, 2012.

* cited by examiner

GOLF BALL WEAR INDICATOR

FIELD

The present invention relates generally to a golf ball including a layer that changes in appearance when exposed to an atmospheric element. The change in appearance alerts a golfer that the performance characteristics of the ball have changed and that the ball should be replaced.

BACKGROUND

The ball selected by a golfer has a great effect on the golfer's score in a round of golf. Golf balls are designed that have varying types of properties, such as a particular size, weight, and density, all of which affect the flight path of the ball.

In addition to these properties, the outer surface of the ball also affects the flight path of the ball. Balls are designed with a variety of dimple sizes and shapes, in addition to being made with various materials that also affect the flight of a ball.

Golf balls may be designed with a particular flight path in mind. If a ball becomes scuffed or otherwise damaged, the flight path of the ball may change. While golfers may be aware that such a change occurs, they may be unaware of what level of scuffing or damage causes a change in the flight path.

Therefore, it may be useful to a golfer to have a ball that includes an indicator that alerts a golfer that a ball surface has deteriorated and that the flight path of the ball may be different from that which was originally intended.

SUMMARY

In one embodiment, an outer composite layer of a golf ball includes a wear indicator that reacts when exposed to an environmental reaction initiator. The outer composite layer includes a top layer, a reacting layer, and a protective layer. The reacting layer is capable of reacting to the initiator. The protective layer is between the top layer and the reacting layer. The protective layer is capable of protecting the reacting layer from exposure to the initiator.

In another embodiment, a golf ball includes a wear indicator that includes a wear indicator that reacts when exposed to an environmental source. The golf ball includes a core and a cover. The cover includes a reacting layer that is radially outward of the core. The reacting layer comprises a reacting material that is capable of reacting when exposed to an environmental source. The cover also includes a protecting layer that is radially outward of the reacting layer. The protecting layer comprises a shielding material that is capable of shielding the reacting layer from the environmental source.

A method of determining whether to use a golf ball is also disclosed. The method includes the steps of striking the golf ball with a golf club, examining the golf ball to determine whether the golf ball has reacted to an environmental source, and choosing to continue to use the golf ball. The method further comprises choosing to discontinue use of the ball and choosing to replace the ball.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

The embodiments disclosed are golf balls having a series of layers forming an outer composite layer or cover. When a ball is being used by a golfer, the outer cover of the golf ball will deteriorate or become damaged through ordinary play. When the ball becomes too deteriorated to provide the designed ball flight, a reacting layer will become exposed and will react to one or more atmospheric elements to alert a golfer that the ball has deteriorated and that a new ball should be selected. The series of layers that alerts the golfer to the deterioration can be considered a wear indicator.

Figure 1:
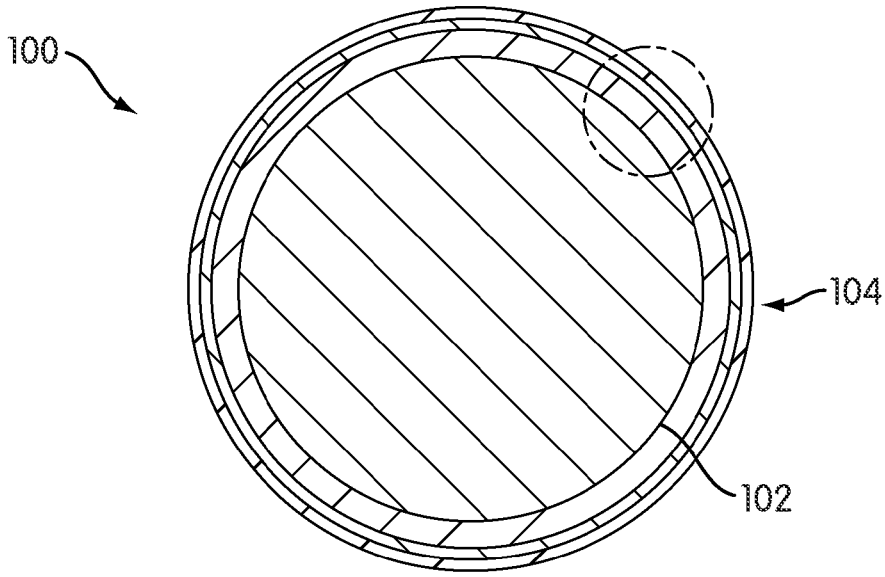
FIG. 1 is a cross section of an embodiment of a golf ball.

FIG. 1 is a cross-sectional view of an embodiment of a golf ball 100. The golf ball 100 has a series of radially or circumferentially arranged layers. The innermost layer is a core 102. The core 102 can be any of a variety of cores commonly used in golf balls. For example, the core 102 could be liquid filled or solid filled. The solid may be rubber, resin, or any other suitable material. The core may also include various types of weights. The core 102 may also include a wound cover. The core 102 may also include a variety of layers. In essence, in the context of the present disclosure, the term "core" includes the portions of the golf ball that do not include the cover or coat. A person having ordinary skill in the art can select a core that produces the technical and flight characteristics that are desirable. While not specifically shown in the FIGS., an optional mantle layer may be included adjacent core 102 or between any two of the other layers where desirable.

Figure 2:
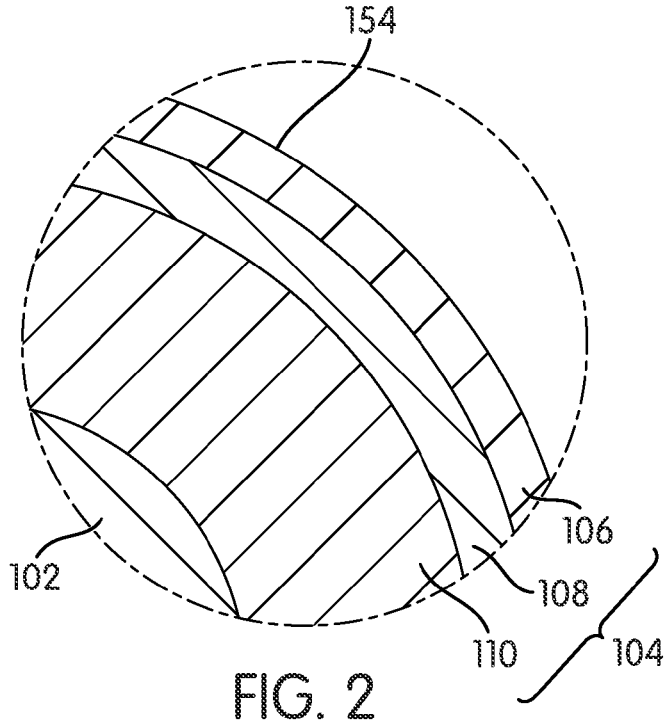
FIG. 2 is an expanded view of a cross section of an embodiment of a golf ball.

Cover or outer composite layer 104 surrounds core 102. Cover 104 is radially outward of core 102. FIG. 2 is an enlargement of the area within the dashed lines of FIG. 1. FIG. 2 shows the layers of cover 104 in greater detail. The layers of cover 104 in FIG. 2 include reacting layer 110, protecting layer 108, and top layer 106. Top layer 106 may surround and be radially outward from protecting layer 108. Protecting layer 108 may surround and be radially outward from reacting layer 110. Reacting layer 110 may surround and be positioned radially outward from core 102.

In the FIGS., top layer 106 is shown in simplified form. In a commercial version, 106 top layer, and in particular, outer surface 154 of top layer 106, is configured to be struck by a golf club. Accordingly, top layer 106 may include various dimples, frets or lands, projections, printing, or any other features that a designer thinks would be desirable in affecting the flight path of the ball 100. Top layer 106 may be designed to be scuff resistant.

Reacting layer 110 may be placed adjacent core 102. Reacting layer 110 includes a reacting material. The reacting material is selected from various materials that react or are capable of reacting when exposed to a corresponding activator. In the present case, it may be desirable for the reacting material to react when it is exposed to an environmental source that is ambient in an environment in which a golfer would likely be golfing. On a standard golf course, there are many items commonly found that can be suitable environmental sources. For example, the reacting material could be sensitive to grass or tree pollen and could react when exposed to such pollens. Alternatively, the material could react when exposed to oxygen, nitrogen or other elements in the air. However, it may be desirable to select a reacting material that reacts to something to which it is only likely to be exposed when it is actively being used as a playing ball on a golf course. While exposure to air or pollen may occur even when a ball is in a golf bag in a garage, some exposures occur only when the ball is in a golf cart for possible play. For example, the reacting material could react when exposed to radiation from the sun. In particular, the reacting material may react when exposed to a particular wavelength of radiation from the sun, such as when exposed to one or more wavelengths of ultraviolet light.

The environmental source may also be considered to be a reaction initiator. In many cases, the reacting material may be a material that remains in one configuration, status, or color, for example, until a reaction is initiated by exposure to an initiator. The initiator is desirably something atmospheric from the golf course atmosphere, such as air, light, grass, or other material that is likely to come into contact with the reacting material and that is capable of initiating a reaction from the reacting material.

The reacting material may react in any of a variety of ways to alert a golfer that it has been exposed to the environmental source or initiator. For example, the reacting material could change size. In such an instance, for example, the reacting material could become larger when exposed to the environmental source. Alternatively, the reacting material could be ionized so as to send an electrical current and alarm to a user indicating that the reacting material has been exposed to the source. As another alternative, the reacting material may change color when exposed to the environmental source.

It may also be useful if the reacting material reacts differently over time. For example, if the reacting material reacts by changing color, the reacting material may change from white to light purple upon initial exposure to the environmental source. Over the course of time, additional exposure could deepen the color of the exposed reacting material. If the reacting material reacts to UV light, the reaction could be considered to be similar to a tan that a person might have, the darker the tan tending to indicate how long the person was exposed to the sun.

Reacting layer 110 may be made partially or entirely from the reacting material. The selection of a desirable reacting material and its concentration in the reacting layer may depend on a variety of factors. These factors may include the compressibility of the material, cost, color, ease of achieving a generally uniform mixture of the material within the layer, and any other considerations a designer may consider to be important or desirable. The proportion of reacting material to the entire material of the reacting layer may vary depending on the amount or concentration of reacting material necessary to be effective to react to the environmental source.

Protecting layer 108 may be adjacent and radially outwardly from reacting layer 110. Protecting layer 108 may be adjacent and radially inward from top layer 106. Protecting layer 108 may include a shielding material that shields or is capable of shielding the reacting material from the environmental source. It may be desirable that the shielding material in protecting layer 108 and the reacting material in reacting layer 110 be selected together so that the shielding material is effective in shielding the reacting material. In some instances, the shielding material could be zinc oxide or titanium oxide, either alone or in combination with another material.

For example, a reacting material in reacting layer 110 may be a material that is sensitive to light waves in the ultraviolet spectrum. The protective material in protecting layer in such an instance may be a material that filters or blocks ultraviolet light waves from penetrating the protecting material. In such an instance, the protecting layer prevents the reacting layer from prematurely being exposed to the initiator or environmental source.

Protecting layer 108 may be made partially or entirely from the protecting material. The selection of a desirable protecting material and its concentration may depend on a variety of factors. These factors may include the compressibility of the material, cost, color, ease of achieving a generally uniform mixture of the material over the layer, and any other considerations a designer may consider to be important or desirable. The proportion of protecting material to the entire material of the protecting layer may vary depending on the amount or concentration of protecting material necessary to be effective to protect the reacting material from the environmental source.

Protecting layer 108 may also be made in whole or in part from materials designed to improve ball flight. The configuration of the top layer may be replicated on the surface of protecting layer 108 to allow protecting layer 108 to improve ball flight. In addition, the protecting layer may be made in whole or in part from a material that has the necessary properties to resist scuffing or other damage caused by a golf club or other item striking the ball.

Figure 3:
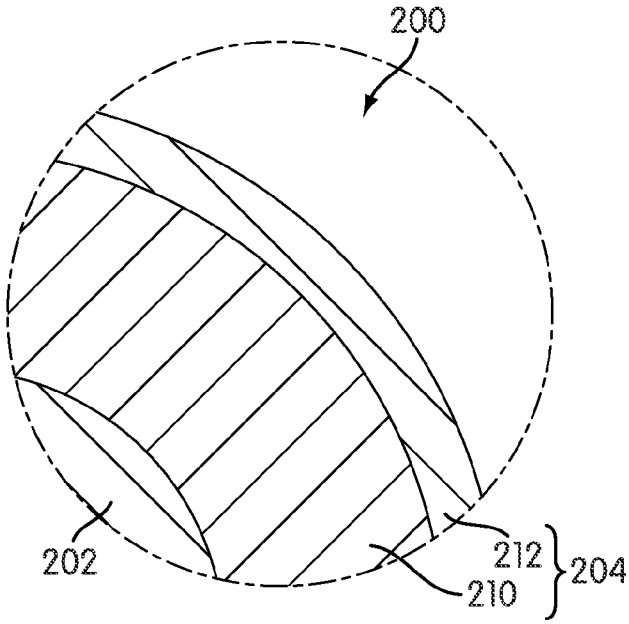
FIG. 3 is an expanded view of a cross section of another embodiment of a golf ball.

An alternative embodiment is shown in FIG. 3. FIG. 3 is a close up view of an alternative configuration of a ball 200 taken in the area of the dashed lines in FIG. 1. Cover or outer composite layer 204 may surround core 202. Cover 204 may be radially outward of core 202. Protecting layer 212 may surround and be radially outward from reacting layer 210. Reacting layer 210 may surround and be radially outward from core 202.

In the embodiment of FIG. 3, core 202 has the same properties and alternatives as were disclosed in relationship to core 102 discussed earlier. Reacting layer 210 has the same properties and alternatives as were disclosed in relationship to reacting layer 110 discussed earlier. A distinction between the embodiment of FIG. 2 and the embodiment of FIG. 3 is the use of a protecting layer 212 in FIG. 3 instead of a protecting layer 108 and a top layer 106 in FIG. 2.

In FIG. 3, protecting layer 212 may be designed to have the features of both protecting layer 108 and top layer 106. For example, protecting layer 212 may include an effective amount of the protecting material discussed earlier in an amount effective to protect the reacting layer 210 from exposure to the initiator. Protecting layer 212 may also have the features of the top layer 106, such as having an outer surface configured with dimples, lands, and other features to allow the outer surface to be struck by a golf club and have a useful flight path. Protecting layer 212 may also be scuff resistant.

Figure 4:
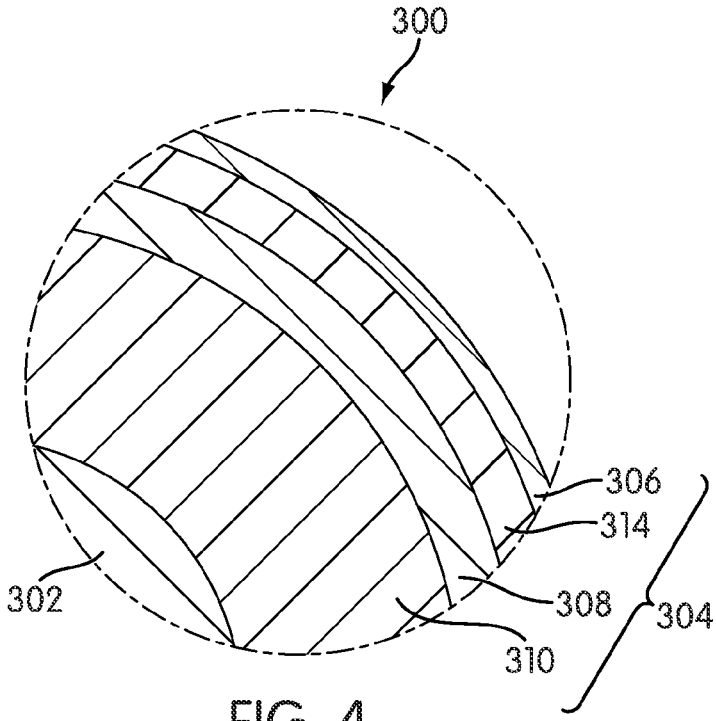
FIG. 4 is an expanded view of a cross section of another embodiment of a golf ball.

Turning now to FIG. 4, yet another embodiment is disclosed. FIG. 4 is a close up view of an alternative configuration of a ball 300 taken in the area of the dashed lines in FIG. 1. Cover or outer composite layer 304 may surround core 302. Cover 304 may be radially outward of core 302. Top layer 306 may surround and be radially outward from secondary layer 314. Secondary layer 314 may surround and be radially outward from protecting layer 308. Protecting layer 308 may surround and be radially outward from reacting layer 310. Reacting layer 310 may surround and be positioned radially outward from core 302.

In the embodiment of FIG. 4, core 302 has the same properties and alternatives as were disclosed in relationship to core 102 and core 202 discussed earlier. Reacting layer 310 has the same properties and alternatives as were disclosed in relationship to reacting layer 110 and reacting layer 210 discussed earlier. Protecting layer 308 has the same properties and alternatives as were disclosed in relationship to protecting layer 108 discussed earlier. Top layer 306 has the same properties and alternatives as were disclosed in relationship to top layer 106 discussed earlier.

A distinction between the embodiment of FIG. 4 and the embodiment of FIG. 2 is the inclusion of a secondary layer, such as secondary layer 314. Secondary layer 314 may be included for a variety of reasons. The inclusion of the materials for the reacting layer and the protecting layer may change the overall compression of the ball or other performance factors. It may be desirable to include a secondary layer that restores such performance factors to a standard condition. In addition, it may be desirable to use more than one protecting layer in some instances. In such cases, a secondary layer can include the protecting or shielding material to provide an additional layer of protection. Alternatively, the secondary layer may include a colorant that changes the appearance of the ball. There may be other reasons or factors that may render it useful to include a layer that includes various properties. While FIG. 4 shows the secondary layer 314 positioned between the protecting layer 308 and the top layer 306, it could be positioned between other layers instead, depending on the purpose for including the secondary layer.

Figure 5:
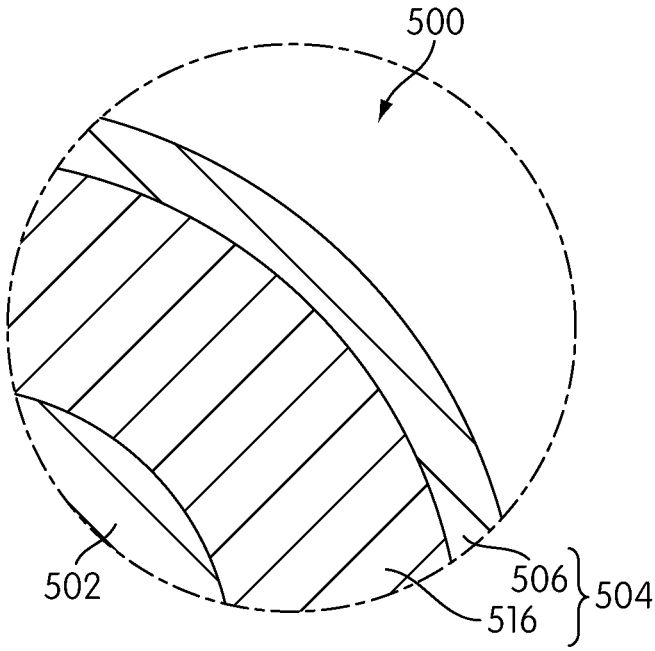
FIG. 5 is an expanded view of a cross section of another embodiment of a golf ball.

Turning now to FIG. 5, yet another embodiment is disclosed. FIG. 5 is a close up view of an alternative configuration of a ball 500 taken in the area of the dashed lines in FIG. 1. Cover or outer composite layer 504 may surround core 502. Cover 504 may be radially outward of core 502. Top layer 506 may surround and be radially outward from active layer 516.

In the embodiment of FIG. 5, core 502 has the same properties and alternatives as were disclosed in relationship to core 102, core 202, and core 302 discussed earlier. In the embodiment of FIG. 5, the properties of the reacting and protecting layers as described in the embodiments of FIGS. 1-4 are combined into active layer 516. Active layer 516 includes both a reacting material being capable of reacting when exposed to an environmental source and a shielding material that is capable of shielding the reacting material from the environmental source. The reacting material and shielding materials used in active layer 516 may be similar or identical to those disclosed in connection with the earlier disclosed embodiments. The proportion of reacting and shielding materials may be any desirable proportion. The thickness of active layer 516 may be about 10 microns. It may be useful to use a dye infusion process to apply active layer 516 to core 502 in this embodiment. A similar dye infusion process could be used in other embodiments to apply at least the reacting layer or material. The method used for such application may be a conventional dye infusion process or may be the dye infusion process disclosed in U.S. Pat. Appl. Publ. No. 2011/0173762 A1, published Jul. 21, 2011, entitled "Systems and Methods for Applying Markings to an Article" filed on Jan. 21, 2010, which application is incorporated herein by reference.

Figure 6:
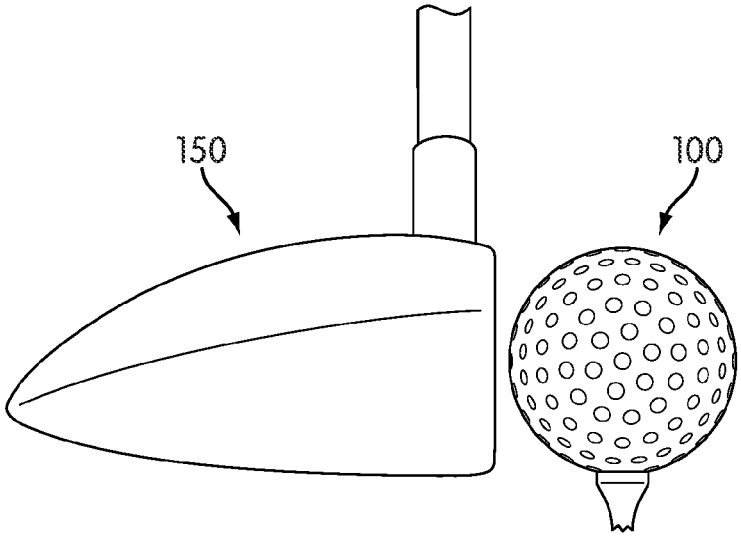
FIG. 6 is a perspective view of a ball being struck by a club.

FIGS. 6-10 show the usage of an exemplary ball. While any of the embodiments disclosed may be used, the ball 100 as shown in FIGS. 1 and 2 is chosen as an exemplary embodiment. FIG. 6 shows the position of a ball 100 relative to an exemplary golf club 150. When golf club 150 strikes golf ball 100, it causes a slight deterioration of the cover 104 of golf ball 100. The flight of the golf ball 100 and the impinging of the golf ball 100 over the golf course also cause deterioration of the cover 104. If the ball 100 lands on grass, the erosion may be less than if the ball 100 hits a tree, a trap, a cart path, a rock, gravel, or any other harder impediment on the course.

Figure 7:
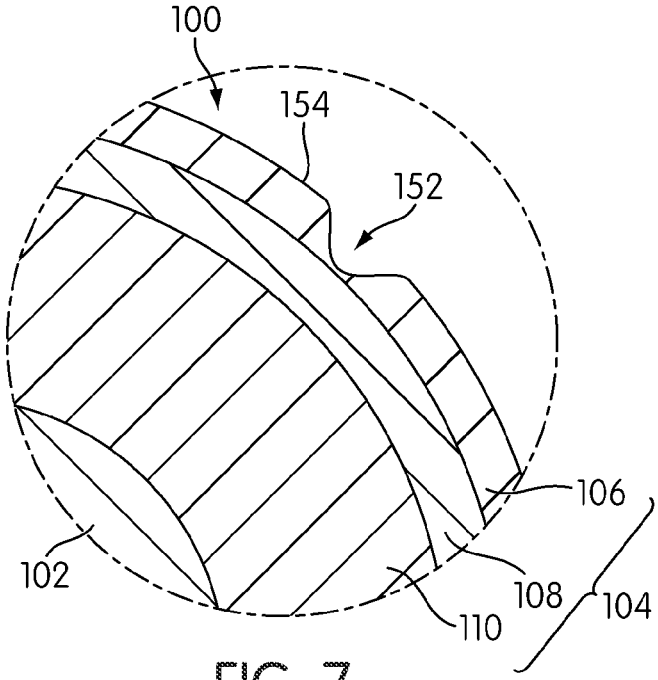
FIG. 7 is an expanded view of a cross section of an embodiment of a golf ball showing wear.

In a closer view, as shown in FIG. 7, the outer or top layer 106 will begin to wear deteriorate, as is shown by the slight indentation as shown at 152. In many golf balls, the top layer 106 may have a thickness of 15 microns or less. Accordingly, the small scuff represented in the area 152 on the ball may be indistinguishable from the rest of the outer surface 154 of the ball, particularly if the ball has dimples or other discontinuities. An average golfer does not typically notice a small scuff of very minimal depth like that shown at 152, and such a small or shallow scuff will not affect the play or the flight path of the ball. In fact, at least a microscopic amount of damage is done to the ball and the top layer 106 each time the ball 100 is struck by a golf club 150 or other item on the golf course, most of which does not negatively affect the flight path of the ball. Accordingly, the golfer will continue to use the ball, possibly unaware of the damage.

Figure 8:
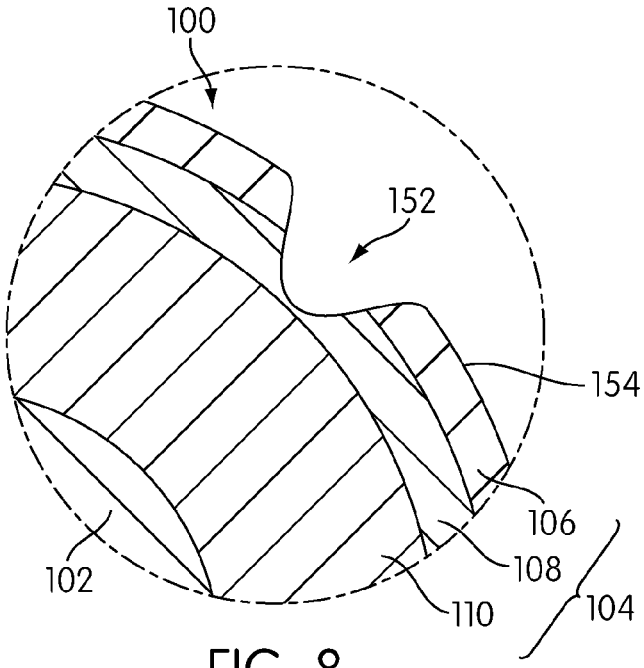
FIG. 8 is an expanded view of a cross section of an embodiment of a golf ball showing wear.

FIG. 8 shows the effect of accumulated deterioration in a particular area over time. Because a golfer is typically unaware of damage occurring to the ball, the golfer will continue to play with ball 100. Over time, the scuffs on ball 100 become deeper through, among other things, a golf club repeatedly hitting a ball in the same area of the ball. Because of these accumulated impacts, top layer 106 will continue to erode until it has reached protection layer 108. Protection layer 108 will then begin to erode or deteriorate, as is shown in FIG. 8, and the area of deterioration 152 will likely become wider and deeper.

Figure 9:
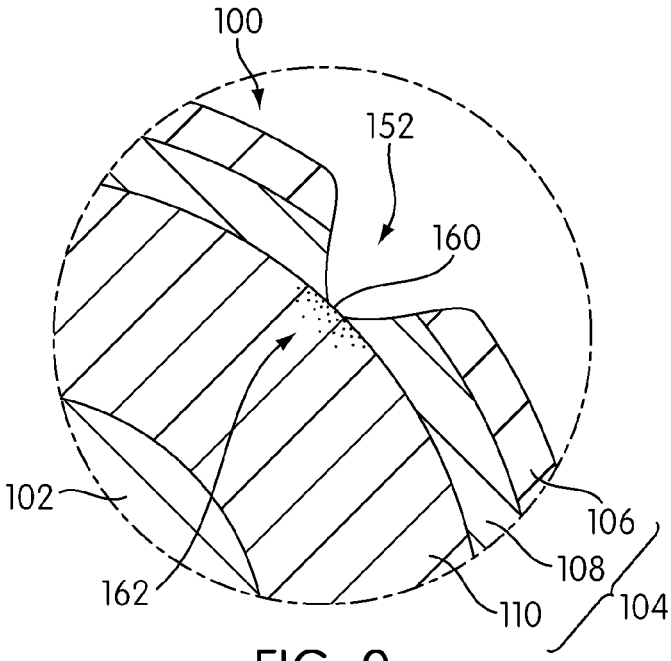
FIG. 9 is an expanded view of a cross section of an embodiment of a golf ball showing wear and a discoloration of a layer.

FIG. 9 shows the effect when the deterioration has reached the level of reacting layer 110. In FIG. 9, the golfer has continued to use ball 100, and a small area of erosion completely through top layer 106 and protecting layer 108 has resulted. This creates an exposed surface or area 160 in or on the reacting layer 110. This exposes the reacting material in reacting layer 110 to the atmosphere surrounding ball 100. As discussed earlier, the reacting material may react to an atmospheric or environmental condition common to golf courses. For example, it may react to ultraviolet rays from the sun. This reaction may cause the reacting material to change color as is shown as a discoloration 162 shown by stippling in reacting layer 110 in FIG. 9. The discoloration 162 may alert the golfer that the deterioration of ball 100 has reached an extent where the flight path of the ball is affected by the deterioration and that therefore, the golfer should discard the ball and use a new ball instead. As discussed in greater detail above, the reaction between the reacting material and the environmental condition may be progressive over time, rather than immediate.

Figure 10:
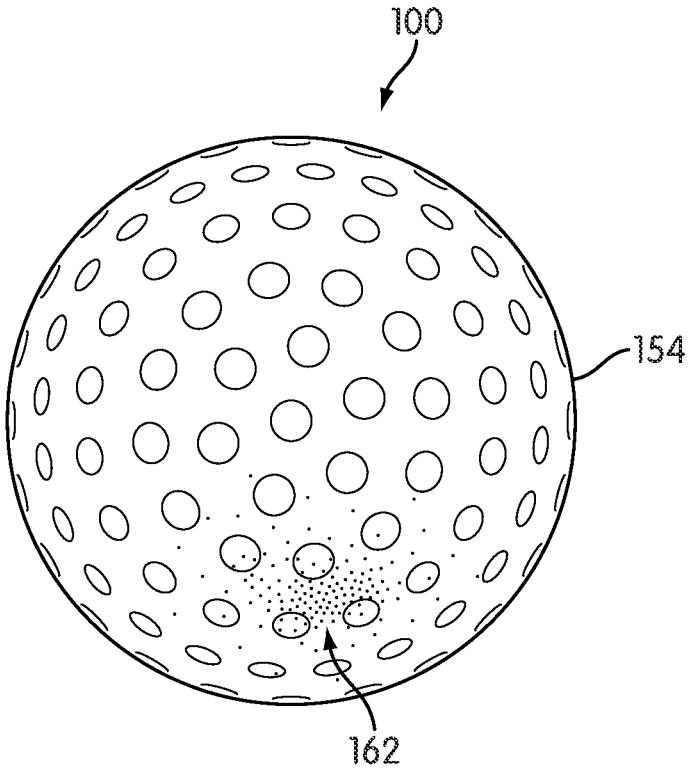
FIG. 10 is a front view of an embodiment of a golf ball showing wear and a discoloration of a layer.

Because of the relative thickness of the layers and the small amount of deterioration provided by any one impact between ball 100 and other items, such as club 150, a golfer is unlikely to notice any one particular area of deterioration alone. Initially, the area of discoloration 162 might be only a few microns across, but area of discoloration 162 enlarges over time. FIG. 9 shows the overall appearance of ball 100 after some deterioration has taken place. As shown in FIG. 10, a golfer is likely only to see outer surface 154 of ball 100. The golfer is likely to be able to note a plurality of discolored areas 162, particularly if discolored areas 162 are concentrated in a particular area of the outer surface 154. The discoloration or other reaction of the reacting material alerts the golfer to the deterioration and the fact that the ball's designed flight path has been affected by the deterioration. If it is important to the golfer to have a particular flight path as the ball was originally designed, the golfer can then decide whether the deterioration is great enough to discard the ball and use a new one.

The wear or deterioration indication provided does not require the changing of the ball. It merely provides information to the golfer that was previously unavailable. Because the outer layers of most golf balls are white, it is difficult for a golfer to determine whether a scuff or wear or a plurality of scuffs or worn areas on a ball are sufficiently great or detrimental to the surface of the ball to affect the flight path of the ball. The inclusion of a layer in the ball that discolors or otherwise changes in appearance to indicate a particular degree of wear may be helpful to a golfer in making this determination. If the flight path of the ball may be affected, the golfer can then choose to discontinue use of the ball and replace the ball, to use it in an area where the golfer frequently mishits the ball into, for example, a water hazard or an area of trees or high grass that makes it difficult to locate a ball, or to continue playing with it even with the deterioration. For example, a golfer with a less consistent stroke profile may not experience an increased score or other negative consequence from the changed flight path of the ball and may wish to continue using it, even with a moderate degree of deterioration, while a golfer with a more consistent swing may choose to discontinue use of the ball and to replace the ball if there is only a slight degree of deterioration, because that golfer has a greater degree of certainty of the designed flight path of the ball. Each golfer can examine the ball with whatever frequency the golfer deems useful to determine whether to continue use of the ball or discontinue use of the ball and replace it with another ball. Each golfer can individually make the decision of when the flight path is too greatly affected to continue to use the ball.

The drawings illustrate layers having a variety of thicknesses and other thicknesses have been mentioned in connection with one or more embodiments. These thicknesses should not be considered to be the only possible thicknesses for the layers. The desirable thicknesses for the various layers depends on the materials a designer wishes to use and the protection or reactivity the designer wishes to provide by the various layers. A person having ordinary skill in the art can modify the present embodiments to provide for a ball having layers of appropriate thicknesses.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. A golf ball that includes a wear indicator that reacts when exposed to an environmental source, the golf ball comprising:

a core; and a cover, the cover comprising:

a reacting layer positioned radially outward of the core, the reacting layer comprising a reacting material that is capable of reacting when exposed to the environmental source, wherein the reacting material is a material that changes color when exposed to ultraviolet radiation, and wherein the environmental source is ultraviolet radiation; and a protecting layer positioned radially outward of and at least partially covering the reacting layer, the protecting layer comprising a shielding material that is capable of inhibiting exposure of the reacting material to ultraviolet radiation, wherein the protecting layer is configured to be eroded over time by impacts from a golf club.

2. The golf ball according to claim 1, further comprising a top layer positioned radially outwardly of the protecting layer.

3. The golf ball according to claim 1, wherein the environmental source is radiation from the sun.

4. The golf ball according to claim 1, wherein the shielding material comprises zinc oxide.

5. The golf ball according to claim 1, wherein the shielding material comprises titanium dioxide.

6. A golf ball, comprising:

a core; and an active layer positioned radially outwardly of the core, the active layer comprising a shielding material and a reacting material, wherein the reacting material is capable of reacting when exposed to an environmental source and the shielding material is capable of shielding the reacting material from the environmental source, wherein the reacting material is a material that changes color when exposed to ultraviolet radiation, and wherein the environmental source is ultraviolet radiation.

7. The golf ball according to claim 6, further comprising a top layer positioned radially outwardly of the active layer.

8. The golf ball according to claim 6, wherein the environmental source is radiation from the sun.

9. The golf ball according to claim 6, wherein the shielding material comprises at least one of zinc oxide and titanium dioxide.

10. A golf ball that includes a wear indicator that reacts when exposed to an environmental reaction initiator, the golf ball comprising:

a core; and a cover disposed radially outward of the core, the cover comprising:

a top layer;

a reacting layer including a material that reacts when exposed to the environmental reaction initiator, wherein the material is configured to change colors when exposed to ultraviolet light waves, and wherein the environmental reaction initiator is ultraviolet light waves;

a protective layer positioned between the top layer and the reacting layer, wherein the protective layer is configured to inhibit exposure of the reacting layer to the environmental reaction initiator; and a secondary layer positioned between the top layer and the protecting layer.

11. The golf ball according to claim 10, wherein the protective layer comprises zinc oxide.

12. The golf ball according to claim 10, wherein the protective layer comprises titanium dioxide.

13. The golf ball according to claim 10, wherein the environmental reaction initiator is selected wavelengths of sunlight.

14. The golf ball according to claim 10, wherein the top layer is formed of a top material that minimizes scuffing.

15. The golf ball according to claim 10, wherein the protective layer is formed of a second material that minimizes scuffing.

* * * * *